United States Patent [19]

Hampton et al.

[11] 4,226,100

[45] Oct. 7, 1980

[54] WATERPROOF PADLOCK CASE

[75] Inventors: Marshall D. Hampton, 2125 S. Ammons, Lakewood, Colo. 80227; Edwin L. Spangler, Jr., Denver, Colo.

[73] Assignee: said Marshall D. Hampton, Lakewood, Colo. ; by said Edwin L. Spangler, Jr.

[21] Appl. No.: 8,065

[22] Filed: Jan. 31, 1979

[51] Int. Cl.[3] ..... E05B 67/38

[52] U.S. Cl. ..... 70/51; 70/53; 70/55

[58] Field of Search ..... 70/20, 25, 26, 38 R, 70/38 A, 38 B, 38 C, 39, 51, 52, 53, 54, 55, 56, 455, DIG. 43; 150/0.5, 52 R

[56] References Cited

U.S. PATENT DOCUMENTS

| | | | |
|---|---|---|---|
| 2,375,488 | 5/1945 | Olson | 70/38 A |
| 2,904,985 | 9/1959 | Murphy | 70/51 |
| 3,848,440 | 11/1974 | Manuel | 70/55 |
| 3,858,419 | 1/1975 | Hampton | 70/55 |

FOREIGN PATENT DOCUMENTS

| | | | |
|---|---|---|---|
| 154804 | 10/1938 | Austria | 70/55 |

*Primary Examiner*—Robert L. Wolfe
*Attorney, Agent, or Firm*—Edwin L. Spangler, Jr.

[57] ABSTRACT

This invention relates to an improved waterproof case for padlocks and, more specifically, to a means for sealing the apertures in such a case at the points where the legs of the shackle enter the latter, such means comprising a self-centering flexible tube loosely fitting the shackle and with the ends thereof engaging either the lid of the case directly or an O-ring seal interposed therebetween to maintain a continuous annular fluid-tight seal around the aforementioned shackle-receiving openings when the shackle is closed and locked. In those versions where the tube ends engage the lock case lid directly to effect the seal, an upstanding annular rib terminating in a feathered edge that functions to enter and flare the tube end and, in so doing, form a fluid-tight annular seal therewith.

10 Claims, 6 Drawing Figures

Fig.-1
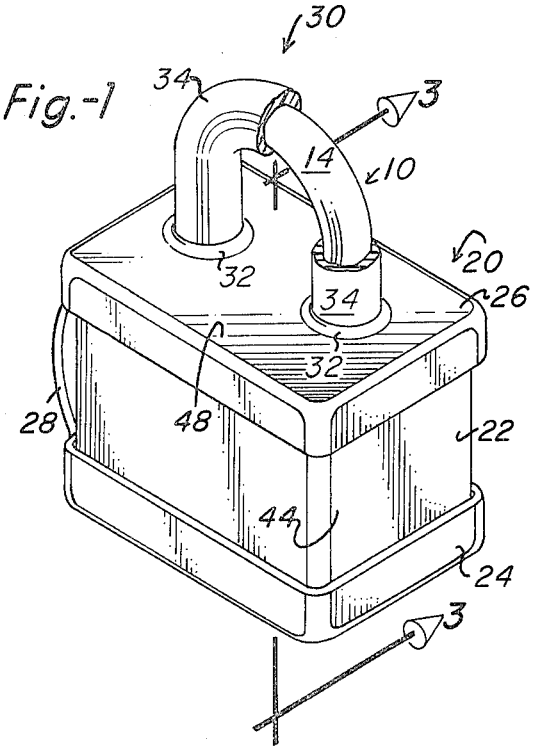
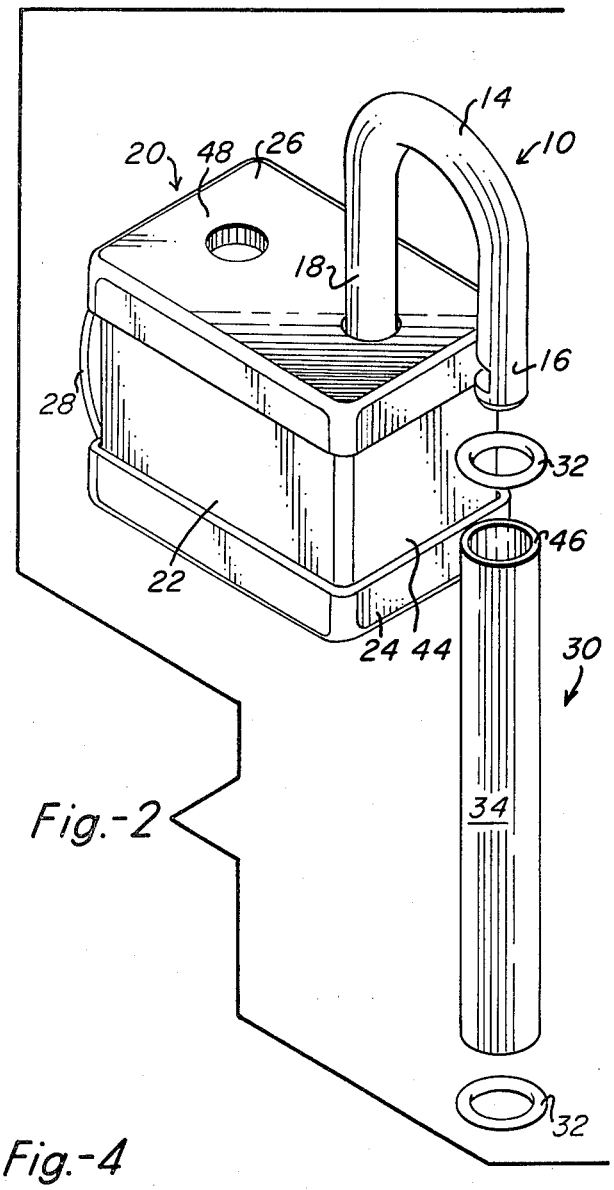
Fig.-2
Fig.-3
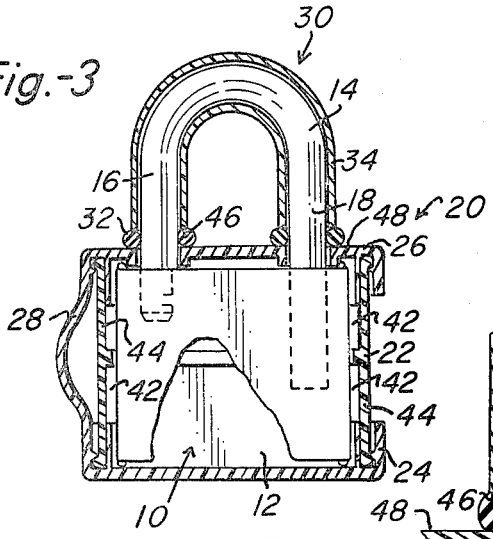
Fig.-4
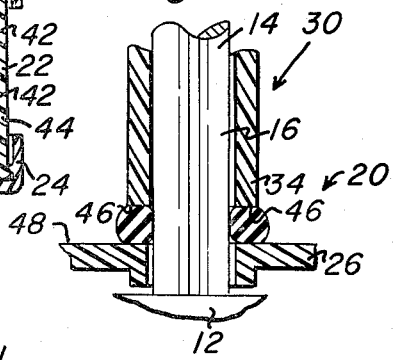
Fig.-5
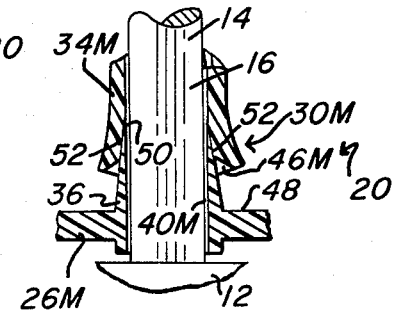
Fig.-6
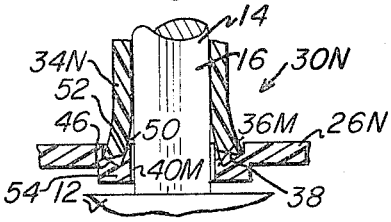

WATERPROOF PADLOCK CASE

In copending application Ser. No. 972,992, filed Dec. 26, 1978, one of the joint inventors herein disclosed an improved water-tight padlock case wherein oversize shackle-receiving openings were provided in the lid that loosely housed the shackle and freed it for movement into open position, each such opening being sealed by a shackle-leg-encircling O-ring held down against the lid of the protective cover by some sort of fixed abutment positioned thereabove that comprised either an integral part of the shackle itself or a stop-forming element mounted thereon. It has now been discovered that an even further simplified form of shackle opening seal can be made by eliminating the fixed abutment altogether and replacing same with a self-centering one in the form of a length of loose-fitting flexible tubing slipped onto the shackle with its ends abutting the O-rings or, alternatively, forming annular fluid-tight seals directly with the lid of the lock case by telescoping down over tapered upstanding annular ribs bordering the shackle openings. In the O-ring version, the shackle-receiving openings can be oversized to loosely receive the shackle thus permitting the latter to spring open freely as opposed to having the lock case drop out of the open bottom of the protective cover. In those versions where the tube ends seal directly against the lid of the protective cover, the shackle-receiving openings preferably fit the shackle legs with a somewhat tighter fit to insure that the upstanding tapered ribs surrounding them telescope up into the oversize tube end with a combination flaring and sealing action.

In addition to the copending application already referred to, the prior art is replete with examples of padlock shackles encased in some kind of flexible tubing such as, for example, the shackles of long shackle bicycle padlocks; however, so far as applicants are aware, these tubular shackle covers were added for the sole purpose of preventing the lock from rattling and/or damaging the finish on the surfaces of the frame where it was carried when not in use. These shackle-protecting tubes usually comprise a length of rubber tubing slipped over the shackle that provided both a sound-deadening action as well as abrasion protection. On the other hand, applicants are unaware of any tube-covered shackle where the tube ends, intentionally or otherwise, were effective to define an annular fluid-tight seal around the shackle-receiving openings in the lid of a protective cover housing the lock case. It is the latter application to which the instant invention is directed.

It is, therefore, the principal object of the present invention to provide a novel and improved waterproof protective cover for padlocks.

A second objective is the provision of a device of the class described which includes a self-centering loose-fitting tubular cover for the shackle that serves both the well-known function of shielding the latter and, in addition, the new function of cooperating with a protective cover housing the case to define fluid-tight annular seals bordering the shackle-receiving openings in the lid thereof.

Another object of the within described invention is to provide a simple kit consisting of protective covers for both the padlock case and shackle that can be put on by the purchaser in a matter of a minute or two and with no special skill being required thus saving assembly time at the manufacturing level.

Still another objective is the provision of a protective cover for padlocks that requires no modification of the padlock whatsoever.

An additional objective of the invention herein disclosed and claimed is to provide a padlock cover that does not interfere with normal operation of the lock while, at the same time, completely enclosing same and isolating it from the action of the elements.

Further objects are to provide a cover of the type aforementioned that is simple, inexpensive, rugged, versatile, easy to install, has no moving parts, is lightweight, compact and even decorative in appearance.

Other objects will be apparent and in part pointed out specifically hereinafter in connection with the description of the drawings that follows, and in which:

FIG. 1 is a perspective view showing an ordinary padlock completely encased in the protective cover of the instant invention, portions of the shackle-covering tube having been broken away and shown in section;

FIG. 2 is an exploded perspective view similar to FIG. 1 and to the same scale but differing therefrom in that the shackle is shown in its open unlocked position swung around to receive the O-ring and tube subassembly;

FIG. 3 is a section taken along line 3—3 of FIG. 1;

FIG. 4 is an enlarged fragmentary section showing the annular seal formed around the shackle-receiving openings in the lid of the protective cover;

FIG. 5 is a fragmentary section similar to FIG. 4 and to the same scale as the latter illustrating a modification wherein the O-ring is eliminated and replaced by an upstanding tapered annular rib bordering the shackle-receiving openings in the lid of the protective cover; and, FIG. 6 is a fragmentary section similar to both FIGS. 4 and 5 and to the same scale showing a further modified form of the FIG. 5 modification wherein a downwardly and outwardly flared annular groove encircles the upstanding ribs at the base thereof.

Referring next to the drawings for a detailed description of the present invention and, initially, to FIGS. 1–4 for this purpose, reference numeral 10 has been selected to broadly designate the lock which will be seen to include a case 12 (FIG. 3) and an inverted U-shaped shackle 14 which, for purposes of the present description will be further broken down into a short leg 16 and a long leg 18. Case 12 and shackle 14 are both conventional in their construction.

The padlock case 12 is completely enclosed inside a protective cover which has been broadly referred to by reference numeral 20 and which includes a hollow rectangular shell 22 encircling the case, a detachable bottom 24 and similarly detachable lid 26 linked together in the particular form shown by an integrally-formed strap 28. This protective cover is essentially the same as that forming the subject matter of my U.S. Pat. No. 3,858,419 except for certain modifications in the lid 26 in the area where the legs of the shackle pass therethrough, the essential features of which will be described in detail presently.

The final element of the assembly consists of the shackle leg seals that have been broadly designated by reference numeral 30 and, of the three different forms shown, one (FIGS. 1, 2 and 3) consists of O-ring seals 32 plus a loose-fitting tubular sleeve 34 on the shackle while the other two (FIGS. 5 and 6) require a modified lid (26M and 26N) for the case 20 which has an upstanding tapered annular rib 36 and in the case of FIG. 6, an annular groove 38 bordering each shackle-receiving openings 40.

In the principal form of the invention shown in FIGS. 1, 2, 3 and 4, it will be seen that the protective cover lid 26 has the shackle-receiving openings 40 therein made oversize so that when the shackle is unlocked, it is free to pop up into open position as designed under the influence of a spring (not shown) inside the case. Essentially all padlock shackles are designed to spring open once unlocked and it is only the presence of the tight-fitting shackle-receiving openings in the lids of most protective covers that prevent them from doing so. Thus, while it is obviously not essential to the sealing of these openings 40 that they be oversize, one of the significant advantages of the principal embodiment of the invention shown in FIGS. 1, 2 and 3 is that the normal operation of the padlock is restored as opposed to the shackle remaining "trapped" so to speak in the lid while the case drops away therefrom. Even with the shackle freed of the lid, the shell 22 must engage the lock case 12 in some fashion to prevent the latter from dropping down and out the open bottom thereof, the bottom 24 having been removed in order to gain access to the keyway (not shown). Oftentimes, the shell will fit the case tightly enough such that the frictional contact therebetween will prevent the case from dropping down through the open bottom. If not, however, some means are preferably provided to insure that this does not take place such as, for example, the integrally-formed ribs 42 on the inside of the shell. As illustrated, the spacing between these opposed pairs of ribs 42 is less than the corresponding dimensions of the padlock case thus causing the deformable plastic shell walls 44 to spring outwardly as shown and, in so doing, yieldably grip the case tightly enough to prevent the latter from dropping down due to its own weight yet, at the same time, permitting it to be easily inserted and withdrawn from the shell. There are, of course, other ways of detachably retaining the case within the shell and the ribs illustrated are intended as being merely representative of such case-retaining means.

The subassembly shown in the first four figures of the drawing for sealing the shackle-receiving openings 40 in the lid of the protective cover 26 consists of two ordinary O-rings 32 and a slightly oversize loose-fitting tubular sleeve 34 fabricated from a pliable but essentially non-compressible material that will slip easily over the shackle while at the same time exerting sufficient pressure against the O-rings when the shackle is closed and locked to press them into continuous annular fluid-tight sealed engagement with the areas on the lid of the protective cover bordering said openings. In order for the subassembly just described to produce and maintain the proper seal, the sleeve 34 must be cut to a length such that when it is seated on the shackle and the latter closed and locked, the sleeve ends 46 should be spaced from the opposed exposed surface 48 of the lid a distance substantially less than the thickness of the O-ring so as to maintain a constant annular pressure all the way around the latter. In addition, of course, the O-rings must be stretched slightly so as to squeeze the shackle legs and produce an annular fluid-tight seal therearound. Now, it would seem at first glance that these sleeve ends 40 should be cut on the bias so that they would each lie parallel to the opposed lid face 48 after being bent around the shackle; however, tests have shown that such is not necessary so long as the sleeve is cut to a length that will compress both O-rings around their entire periphery. While the sealing pressure thus exerted may not be uniform, it remains adequate at its lowest value to effectively seal out moisture at ambient pressure along with other contaminants. The simplicity of right-angle cut sleeve ends 46 far outweighs the doubtful advantage of bias cut ones capable of maintaining a constant sealing pressure all the way around the O-rings especially since such a bias-cut sleeve would have to be carefully oriented, i.e. rotated to the proper position on the shackle before it would function as intended. Moreover, there would always be the chance, accidently or otherwise, of getting the sleeve rotated half a turn the wrong way in which event its sealing capability would be far worse than the straight cut sleeve. It is quite possible that in time the bias-cut sleeve would turn itself into the proper position regardless of how it was mounted on the shackle initially but, here again, there is no assurance it would do so and the gains in terms of a more uniform sealing pressure are not all that significant.

The internal diameter of the sleeve should be such as to allow it to slip easily onto the shackle and, once so mounted, to seek and maintain a centered position thereon effective to maintain a substantially equal, but not necessarily uniform, pressure against both O-rings. A lubricant at the interface between the sleeve and shackle can be used if necessary; however, it should be one that is inert and will not damage the sleeve while, at the same time, maintaining its lubricant properties over the wide range of ambient temperatures in which the padlock might be used such as, for example, +150° F. down to −60° F. or thereabouts. Also, by using a relatively thick-walled tube for the sleeve 34, it can fit the shackle somewhat more loosely and still possess sufficient rigidity to compress the O-rings into sealed engagement. As illustrated, the tube wall thickness is something over half the thickness of the O-ring.

Next, with specific reference to FIGS. 5 and 6, a modified form of seal will be described in which no O-rings 32 are used but instead, the lid 26 of the protective cover is modified to perform the sealing function in combination with the sleeve 34. The modified form of seal 30M forming the subject matter of FIG. 5 uses a slightly modified sleeve 34M that differs from the one just described in the principal embodiment only in the fact that its length need not be quite as critical. As far as modifications to the lid 26M are concerned, they consist mainly of a slightly smaller and tighter fitting shackle-receiving opening 40M and an upstanding tapered annular rib 36 bordering each of the shackle-receiving openings and terminating at the rim thereof in a feathered edge 50 effective to telescope up inside the loose-fitting sleeve and flare the lower end out to produce a continuous annular fluid-tight seal 52 between the mating telescoped surfaces thereof. The ends 46M of the sleeve should, preferably, be chamfered as shown along the inside marginal edge to produce a wide-mouthed entryway adapted to cam the rib into telescoped relation therein. Since the annular seal will be produced by the tapered rib flaring the sleeve end, the same degree of precision required in the O-ring subassembly previously described is not required.

Finally in FIG. 6, the sleeve 34N is made longer so as to enter annular grooves 38 bordering the shackle-receiving openings 40M in the lid. The lid includes a thickened section 54 at this point to accommodate the groove. Groove 38 flares downwardly and outwardly to accommodate the flared end of the sleeve as it passes down onto upwardly-tapered continuous annular rib 36M. This rib also terminates along its rim in a feathered edge 50; however, it is shown differing somewhat from rib 36 in FIG. 5 in that it is shorter and with a steeper taper merging into the inner wall of circumferential groove 38. Continuous annular fluid-tight seal 52 is produced once again between the mating opposed surfaces of the rib and sleeve but, in addition, a second annular seal 56 is formed when the sleeve end 46 seats in the bottom of groove 38. In the case of the FIG. 6 modification, either a straight-cut sleeve end 46 or a wide-mouthed one 46M (FIG. 5) will function satisfactorily to form the desired fluid-tight seals.

What is claimed is:

1. In a protective cover for padlocks having a case with a keyway in one end and the legs of a U-shaped shackle entering the other:

a box-like housing having a case-encircling body open at both ends, a base detachably connected to the open end where the keyway is located providing access to the latter and a lid detachably connected to the other open end, said lid having shackle leg receiving openings therein positioned and adapted to pass the shackle legs;

a loose-fitting pliable tubular sleeve mounted on the shackle of a length such that the ends thereof terminate adjacent the shackle receiving openings in the lid when said shackle is closed and locked; and, annular means encircling the shackle legs cooperating therewith and with the sleeve ends to define continuous fluid-tight seals around both shackle leg receiving openings in the lid.

2. The protective cover as set forth in claim 1 wherein the annular means comprise O-ring seals carried by the shackle legs.

3. The protective cover as set forth in claim 1 wherein the annular means comprise upstanding annular ribs bordering the shackle leg openings in the lid, said ribs each terminating in an edge at the upper end thereof sized to enter the adjacent end of the loose-fitting sleeve, and the portion of said ribs between said lid and edge being tapered so as to flare the sleeve upon entering same.

4. The protective cover as set forth in claim 2 wherein the sleeve ends lie spaced from the adjacent surface of the lid with the shackle closed and locked a distance less than the thickness of the O-ring seals, and wherein the thickness and rigidity of the sleeve relative to the O-ring is sufficient to compress the latter into fluid-right annular engagement with the lid.

5. The protective cover as set forth in claim 3 wherein the lid contains annular grooves adapted to receive the sleeve ends and form annular fluid-tight seals therewith bordering the upstanding ribs at the base thereof; and, where in the sleeve is of a length such that the ends thereof enter and seat within said grooves when the shackle is closed and locked.

6. The protective cover as set forth in claim 3 wherein the sleeve ends are chamfered to cooperate with the edges of the ribs so as to cam the latter into telescoped relation inside the former upon relative axial movement toward one another.

7. The protective cover as set forth in claim 5 wherein the annular grooves flare downwardly and outwardly to accomodate the flared sleeve ends.

8. The subcombination for use on the legs of a U-shaped padlock shackle to form a continuous annular fluid-tight seal around the shackle leg openings in the lid of a protective cover housing the padlock case which comprises:

a loose-fitting pliable tubular sleeve mountable on the shackle, said sleeve having ends terminating in spaced relation to the surface of the lid having the shackle leg openings therein; and, O-ring seals encircling the legs of the shackle bridging the space between the tube ends and lid surface when the shackle is closed and locked.

9. The subcombination of claim 8 wherein the space between the sleeve ends and lid surface is less than the thickness of the O-rings.

10. The subcombination of claim 8 wherein the thickness and rigidity of the sleeve relative to the O-ring is such that the former will compress the latter into fluid-tight contact with the lid when the shackle is closed and locked.

* * * * *